US007740108B2

(12) United States Patent
Adkins

(10) Patent No.: US 7,740,108 B2
(45) Date of Patent: Jun. 22, 2010

(54) EXPANDABLE SAWHORSE-TYPE SUPPORT FOR WORK PIECES INCLUDING SHEET MATERIAL

(75) Inventor: Edward D. Adkins, Loves Park, IL (US)

(73) Assignee: Nomis LLC, Hampshire, IL (US)

( * ) Notice: Subject to any disclaimer, the term of this patent is extended or adjusted under 35 U.S.C. 154(b) by 0 days.

(21) Appl. No.: 11/694,274

(22) Filed: Mar. 30, 2007

(65) Prior Publication Data

US 2007/0246300 A1 Oct. 25, 2007

Related U.S. Application Data

(60) Provisional application No. 60/788,143, filed on Mar. 31, 2006.

(51) Int. Cl.
*E04G 1/34* (2006.01)

(52) U.S. Cl. ..... 182/153; 182/181.1

(58) Field of Classification Search ..... 248/167; 182/153, 181.1
See application file for complete search history.

(56) References Cited

U.S. PATENT DOCUMENTS

| | | | | |
|---|---|---|---|---|
| 129,978 | A | 7/1872 | Noggle | |
| 615,364 | A | 12/1898 | Porten | |
| 862,725 | A | 8/1907 | Fietsam | |
| 965,173 | A | 7/1910 | Fassler | |
| 3,604,306 | A * | 9/1971 | Denholm | 411/535 |
| 4,031,981 | A * | 6/1977 | Spencer | 182/153 |
| 4,159,821 | A | 7/1979 | Hickman | |
| 4,251,106 | A | 2/1981 | Gilbert | |
| 5,518,082 | A * | 5/1996 | Liao | 182/181.1 |
| 5,954,156 | A | 9/1999 | Cooke | |
| 6,073,894 | A * | 6/2000 | Chen | 248/165 |
| 6,092,770 | A * | 7/2000 | Battocchio | 248/171 |
| 6,499,705 | B1 * | 12/2002 | Tsai | 248/167 |
| 6,581,223 | B1 | 6/2003 | Wang | |
| 6,968,790 | B1 * | 11/2005 | Kocsis | 108/157.1 |
| 7,114,205 | B2 | 10/2006 | Choi | |
| 7,377,504 | B2 * | 5/2008 | Houldsworth | 269/296 |
| 2001/0051009 | A1 * | 12/2001 | Shimizu et al. | 384/45 |
| 2004/0051009 | A1 * | 3/2004 | Chen | 248/163.1 |
| 2004/0084581 | A1 * | 5/2004 | Chang | 248/166 |
| 2005/0224291 | A1 | 10/2005 | Fasanella | |

* cited by examiner

*Primary Examiner*—Alvin C Chin-Shue
(74) *Attorney, Agent, or Firm*—Reinhart Boerner VanDeuren P.C.

(57) ABSTRACT

An apparatus and method, for supporting a work piece, utilize an expandable articulated support frame having a plurality of telescopic columns arranged in rows and interconnected by a plurality of connecting rods pivotably connected to each other and the telescopic columns at intersections thereof, with upper ends of the telescopic columns being adapted for supporting the work piece thereupon.

22 Claims, 8 Drawing Sheets

EXPANDABLE SAWHORSE-TYPE SUPPORT FOR WORK PIECES INCLUDING SHEET MATERIAL

CROSS-REFERENCE TO RELATED PATENT APPLICATIONS

This patent application claims the benefit of U.S. Provisional Patent Application No. 60/788,143, filed Mar. 31, 2006, the disclosure and teachings of which are incorporated herein in their entireties, by reference.

FIELD OF THE INVENTION

This invention relates to support structures useful in construction, and more particularly to supporting work pieces, including sheet materials, at a convenient height for carpentry, plumbing, residential and/or commercial construction, and the like.

BACKGROUND OF THE INVENTION

Sawhorses, and similar types of work piece supports, have been used in the construction trades for centuries. Through the years, there have been many attempts to improve upon the basic sawhorse or work table, as evidenced by U.S. Pat. Nos. 129,978, to Noggle; 615,364, to Porten; 862,725, to Fietsam; 965,173, to Fassler; 5,954,156, to Cooke; 4,159,821, to Hickman; and Published U.S. Patent Application No. 2005/0224291 A1, to Fasanella.

Through the centuries, however, the basic construction of sawhorses has remained fundamentally unchanged. Although different materials have been utilized, different methods of interconnecting the basic elements of the sawhorse have been developed, and various types of adjustments added to the basic sawhorse structure, sawhorses are still best suited to their initial purpose, that of supporting elongated boards or other work pieces to facilitate construction activities. Sawhorses were initially invented long before the advent of modern sheet-type construction materials, such as plywood and sheet rock type materials. Consequently, it is not surprising that sawhorses in their original or modern forms are not well suited for use with sheet type materials.

Small collapsible work benches, of the type disclosed in Hickman '821, are also not well suited to support of sheet-type materials.

In addition, conventional sawhorses and collapsible work supports, such as the one disclosed in Hickman '821, typically are either quite bulky, even when in a folded condition, or are cumbersome to set up and re-stow before and after use.

It is desirable, therefore, to provide an improved apparatus and method for supporting a work piece, and in particular sheet-type work pieces, at a comfortable level for working on the work piece. It is further desirable that such an improved apparatus and method be accomplished in a manner which facilitates set-up and stowage of the support structure, before and after use respectively.

BRIEF SUMMARY OF THE INVENTION

The invention provides an improved apparatus and method for supporting a work piece, through the use of an expandable articulated support frame having a plurality of telescopic columns arranged in rows and interconnected by a plurality of connecting rods pivotably connected to each other and the telescopic columns at intersections thereof, with the upper ends of the telescopic columns being adapted for supporting a work piece thereupon. The expandable articulated frame may be readily deployed in an expanded position, for use, and then be contracted to a stowed position for transport and storage. When deployed in the expanded position, the expandable articulated support frame provides support for a wide variety of work pieces, including sheet-type materials.

In some forms of the invention, multiple expandable articulated support frames are utilized in combination for supporting a work piece. In some forms of the invention, one or more sections of an expandable articulated support frame, according to the invention, may be detached from other sections of the expandable articulated support frame, in a manner allowing individual sections of the expandable articulated support frame to be selectively coupled together, or disconnected from one another, for use in a manner most conducive to performing a particular task, or for fitting within an available work space. Various sizes of expandable articulated support frames, according to the invention, may also be marketed separately, thereby allowing a consumer to purchase only those sections required for a given project, or to customize the configuration of the expandable articulated support frame for meeting the needs of a particular work situation, such as supporting a very large sheet of material, for example.

The upper ends of the telescopic columns may have a variety of configurations suitable for a virtually unlimited number of applications. For example, the upper ends of one or more of the telescopic columns may include a support pad affixed thereto formed from a material, such as a particle board or plastic, which, when struck by saws, routers, or other types of tools and bits utilized in the construction trades, will not tend to dull or cause damage to those tools and bits. Such pads may be attached to the upper ends of the telescopic columns in a manner allowing them to be readily replaced when they have become worn. Such pads may also have a thickness extending some distance above the upper ends of the telescopic columns, to thereby preclude having tools come into direct contact with the upper ends of the telescopic columns.

In some forms of the invention, the upper ends of the telescopic columns are constructed in a manner allowing attachments to be operatively joined thereto, with such attachments including, but not being limited to, bench dog-type devices, hold down clamps, and/or cradles having a recess therein for holding elongated work pieces such as pipes or structural lumber. Such cradles may also be configured for receipt therein of elongated materials, such as lengths of 2×4 lumber, for example, to thereby form transversely extending support rails for use in certain construction projects, such as the support of long lengths of lumber, pipe, etc.

The telescoping columns may include an inner vertical element slidingly disposed within an outer tubular element. In some forms of the invention, the telescopic columns are constructed in such a manner that an end of the vertical support member inside the tubular member rests against a stop when the expandable articulated support structure is positioned in the expanded position. In some forms of the invention, the stop is integral with a foot of the telescopic column, thus providing a solid support at each column when the frame is in the fully expanded position.

In some forms of the invention, a work piece support at the upper end of the telescopic columns includes a central pivot point positioned substantially above the telescopic column in a manner allowing the work piece support to be pivoted in a substantially horizontal plane about the upper end of the telescopic column. A work piece support, according to the invention, may further define a through-hole, or other type of receptacle therein, for operative attachment of hold downs, cradles, bench-dogs, etc. In some forms of the invention, a work piece support which is both pivotable and includes a through-hole or other receptacle may have a pear-shaped periphery to facilitate nesting of the work piece supports when the expandable articulated support frame is collapsed into the stowed position.

An apparatus and/or method, according to the invention, may further include providing a storage/carrying case adapted for receiving one or more expandable articulated support frames, according to the invention, therein. Such a stowage case may further include additional provisions for stowage of associated articles such as hold-down clamps, work piece support cradles, bench-dogs, etc.

The invention may be practiced in a variety of forms, including an apparatus, and methods for utilizing, constructing, or marketing an apparatus, according to the invention, or portions thereof.

Other aspects, objects and advantages of the invention will be apparent from the following detailed description and drawings of exemplary embodiments.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
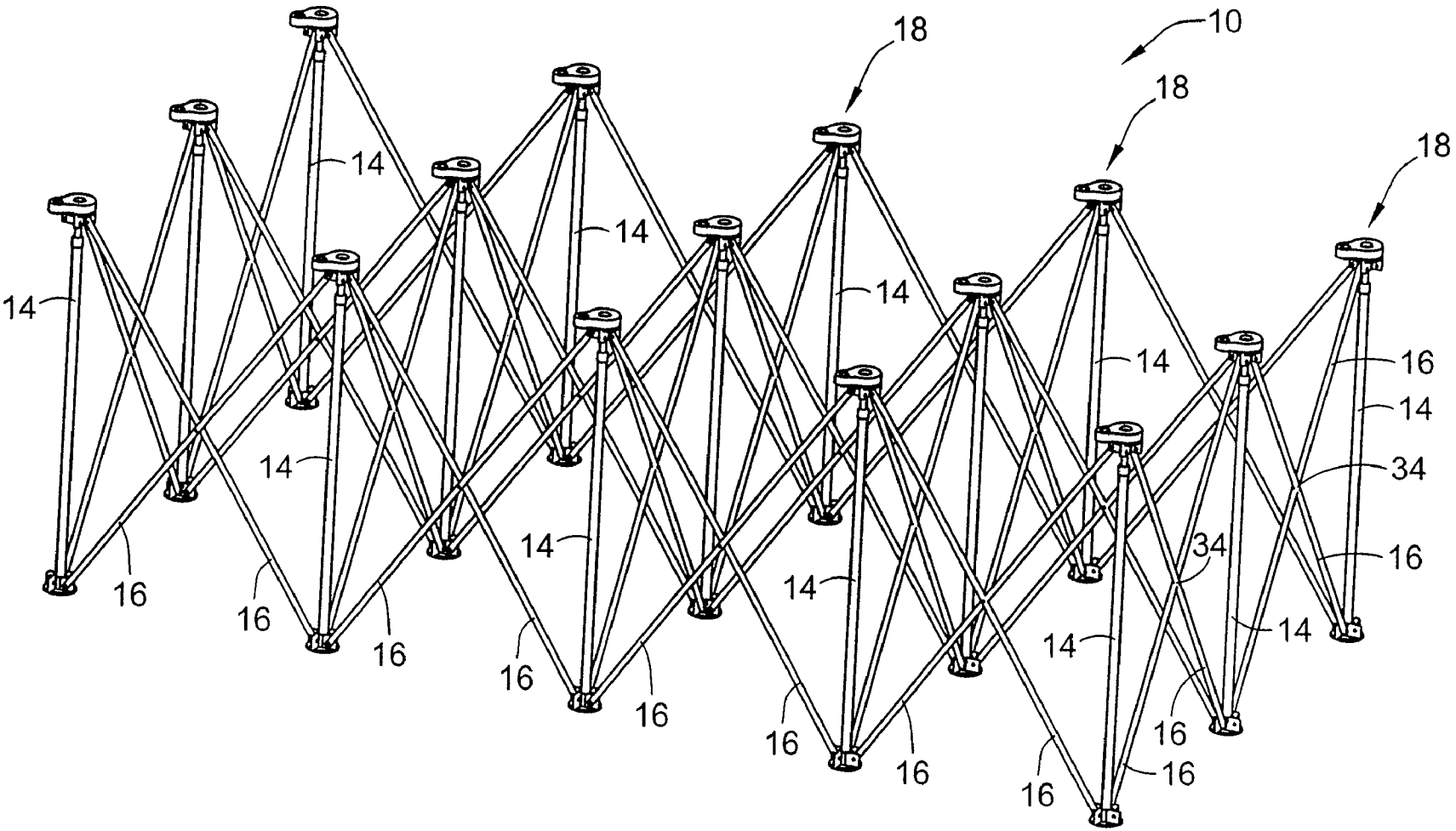
FIG. 1 is a perspective illustration of an exemplary embodiment of a work piece support apparatus, having an expandable articulated support frame, according to the invention.
Figure 2:
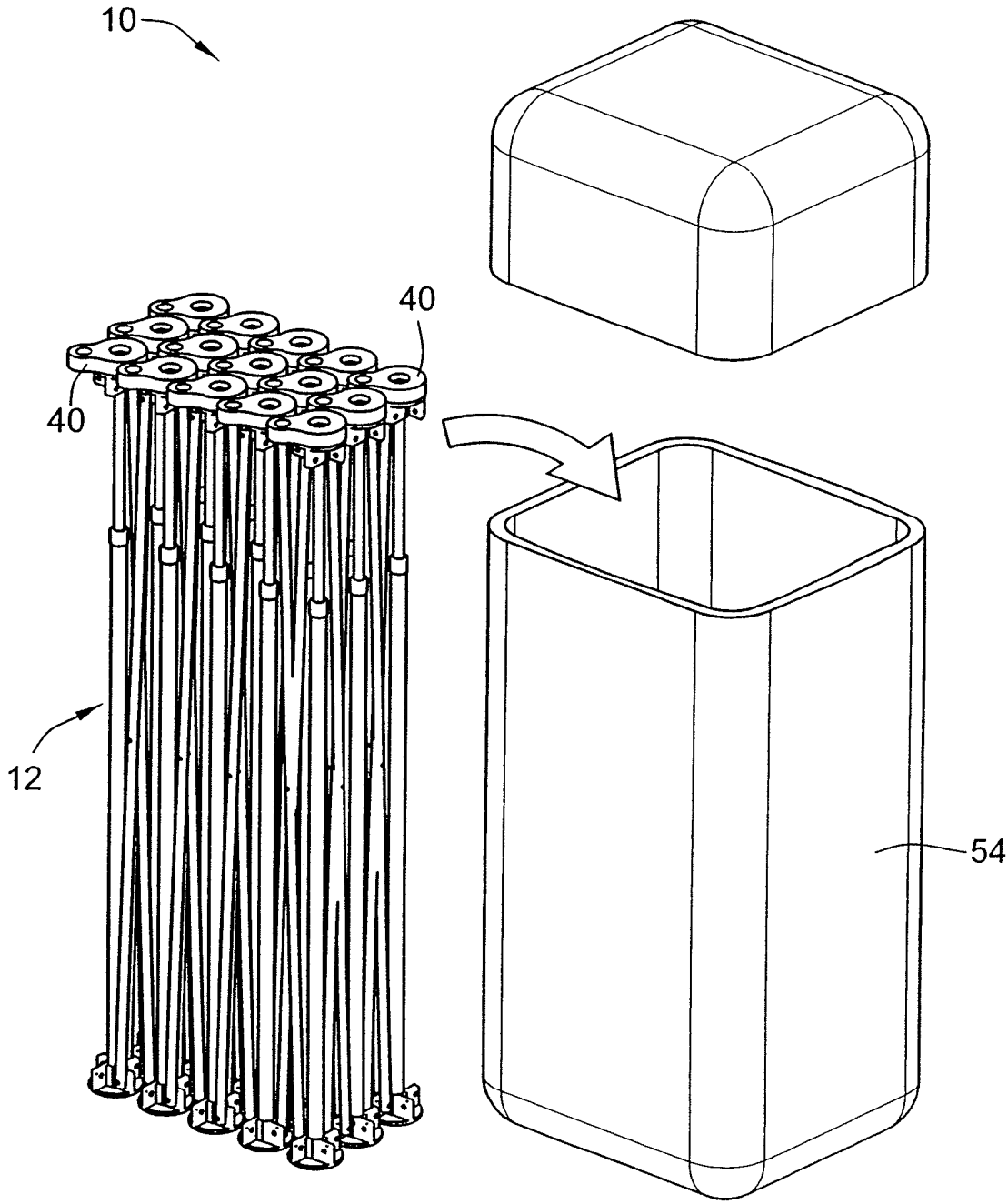
FIG. 2 is a perspective illustration of the work piece support apparatus of FIG. 1, disposed in a contracted, stowed position.

FIGS. 1 and 2 show an exemplary embodiment of a work piece support apparatus 10 according to the invention, in a deployed expanded position (FIG. 1), and a contracted stowed position (FIG. 2).

Figure 3:
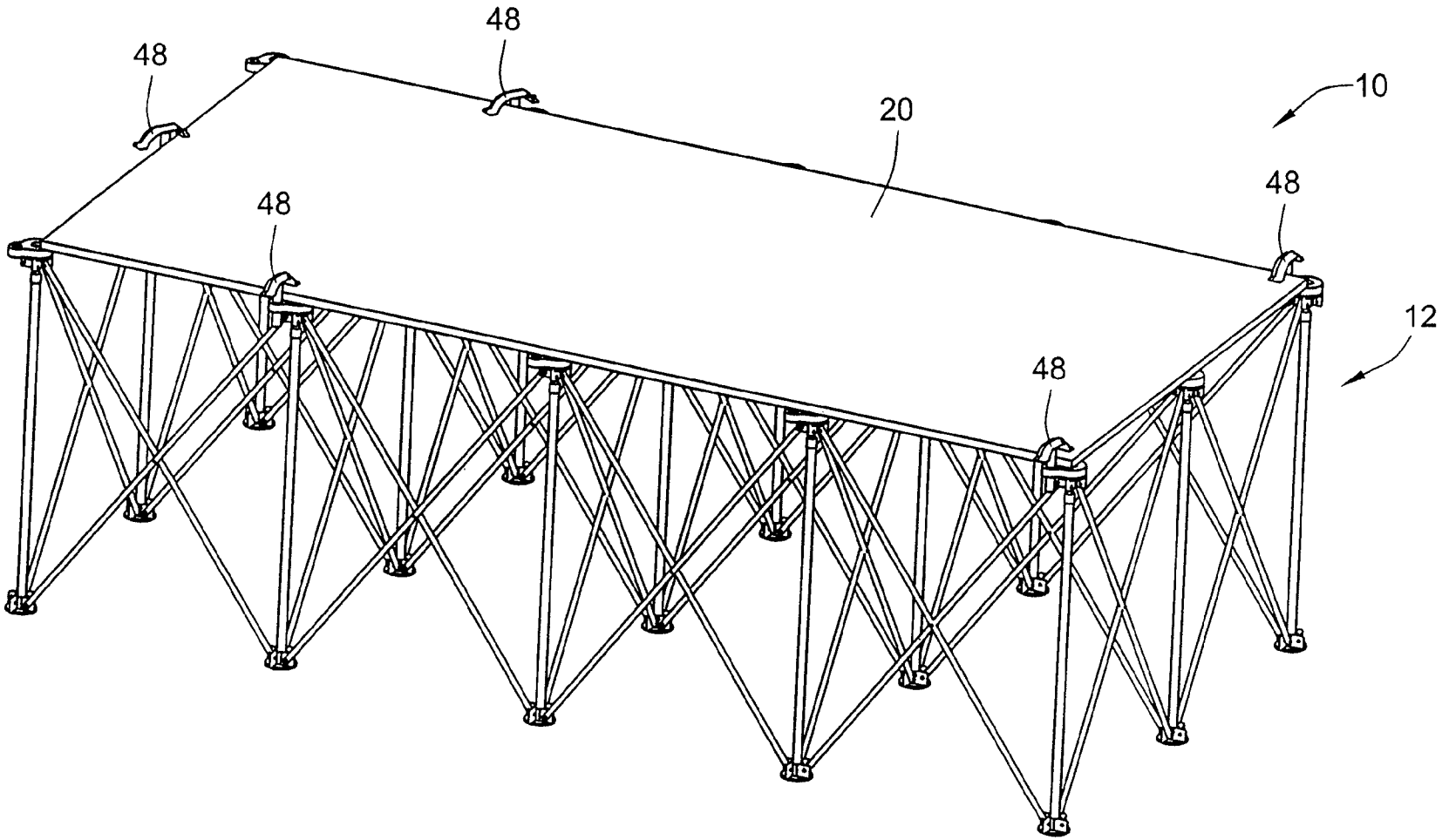
FIGS. 3 and 4 are a perspective illustrations showing various work pieces supported upon the work piece support apparatus of FIG. 1.
Figure 4:
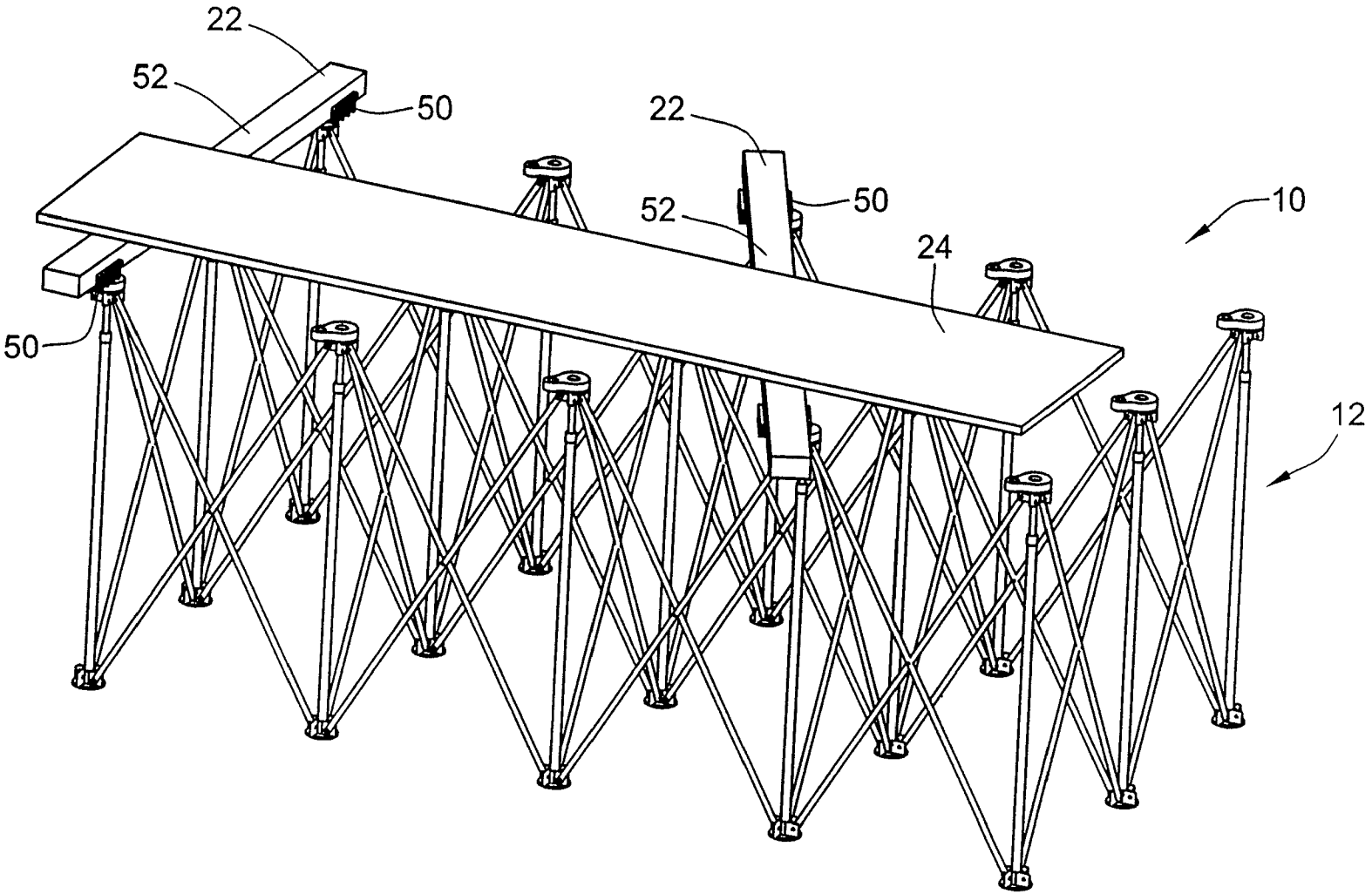

The exemplary embodiment of the work piece support apparatus 10 includes an expandable articulated support frame 12 having a plurality of telescopic columns 14 arranged in rows and interconnected by a plurality of connecting rods 16 which are pivotably connected to each other and the telescopic columns at intersections thereof. The upper ends 18 of the telescopic columns 14 are adapted for advantageously supporting a wide variety of work pieces 20, 22, 24, thereupon, as shown in FIGS. 3 and 4, when the support frame 12 is deployed in the expanded position. Referring to FIGS. 1 and 2, it will be seen that the exemplary embodiment of the expandable articulated support frame 12 includes a total of fifteen (15) telescopic columns 14 (not all of which are numbered in FIG. 1) arranged in essentially a two foot grid pattern which will provide excellent support for a 4'×8' sheet of material, in the manner shown in FIG. 3.

Figure 5:
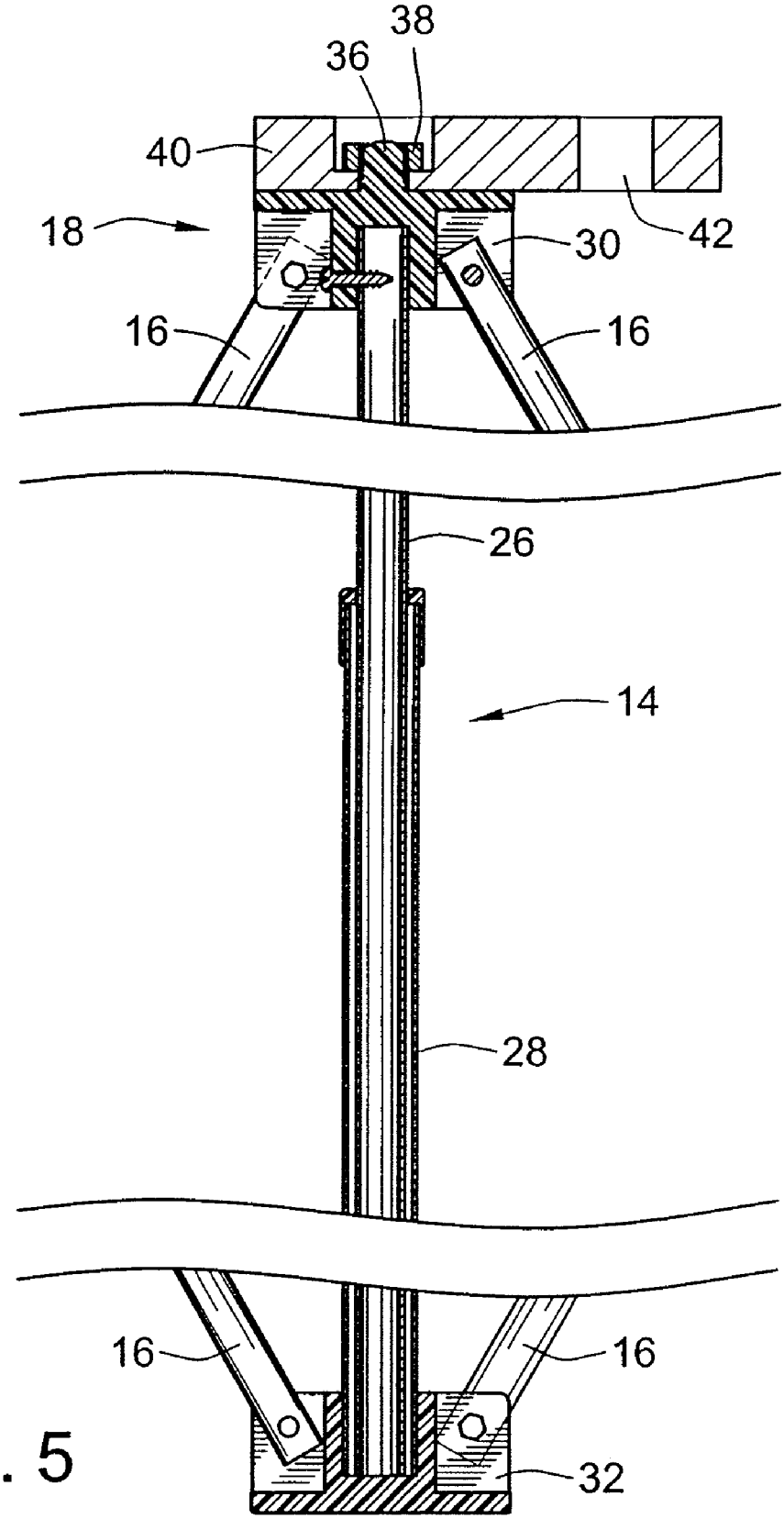
FIGS. 5-7 show construction details of various components of the exemplary embodiment of the work piece support apparatus of FIG. 1.
Figure 6:
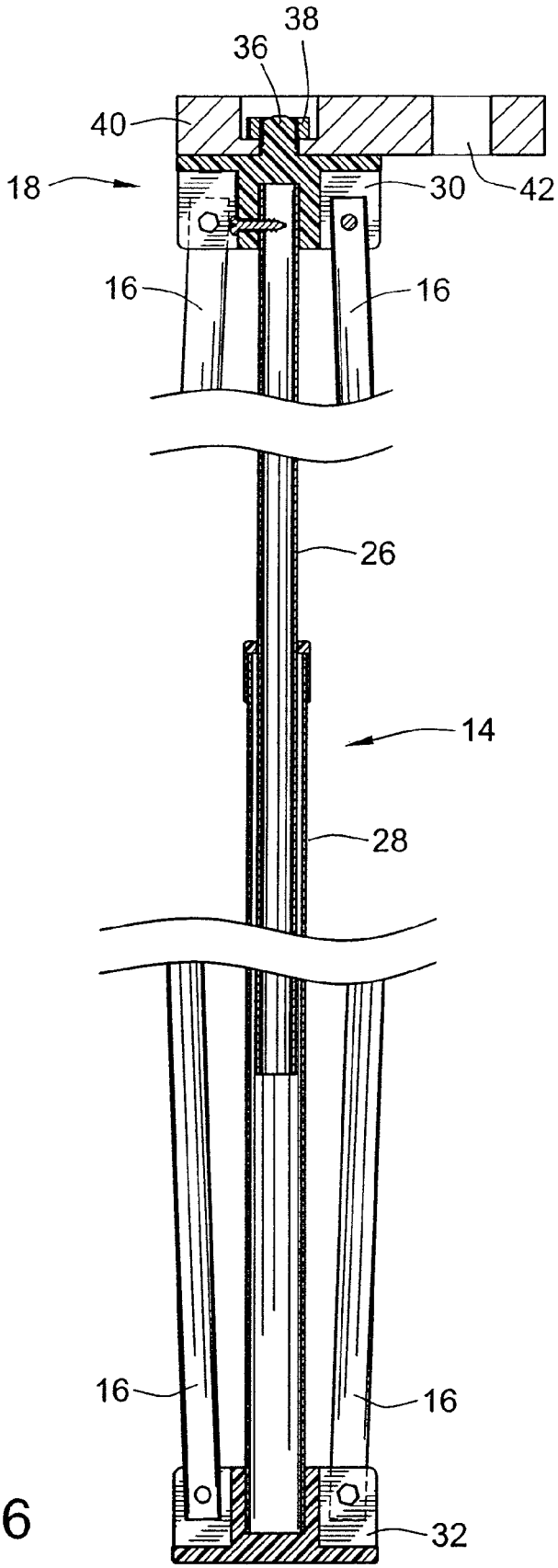

As shown in FIGS. 5 and 6, each of the telescopic columns 14 includes an inner vertical element 26 slidingly disposed within an outer tubular element 28. A guide is provided at the interface of the inner vertical element 26 and the outer tubular element, to facilitate smooth, low-friction movement of the telescopic column 14.

In the exemplary embodiment, the inner and outer elements 26, 28 are both fabricated from circular tubular material, but it will be understood that in other embodiments, the inner vertical element 26 and the outer tubular element 28 may have configurations which are non-circular. In addition, it will be understood that in other embodiments of the invention, the inner vertical element may be formed of solid, rather than tubular material. It is generally contemplated, however, that it will be preferred to form both the inner vertical element 26 and outer tubular element 28 of thin-walled tubing of metal, composite or another suitable material, in order to minimize weight of the expandable articulated support frame 12, to thereby facilitate portability of the work piece support apparatus 10.

Figure 7:
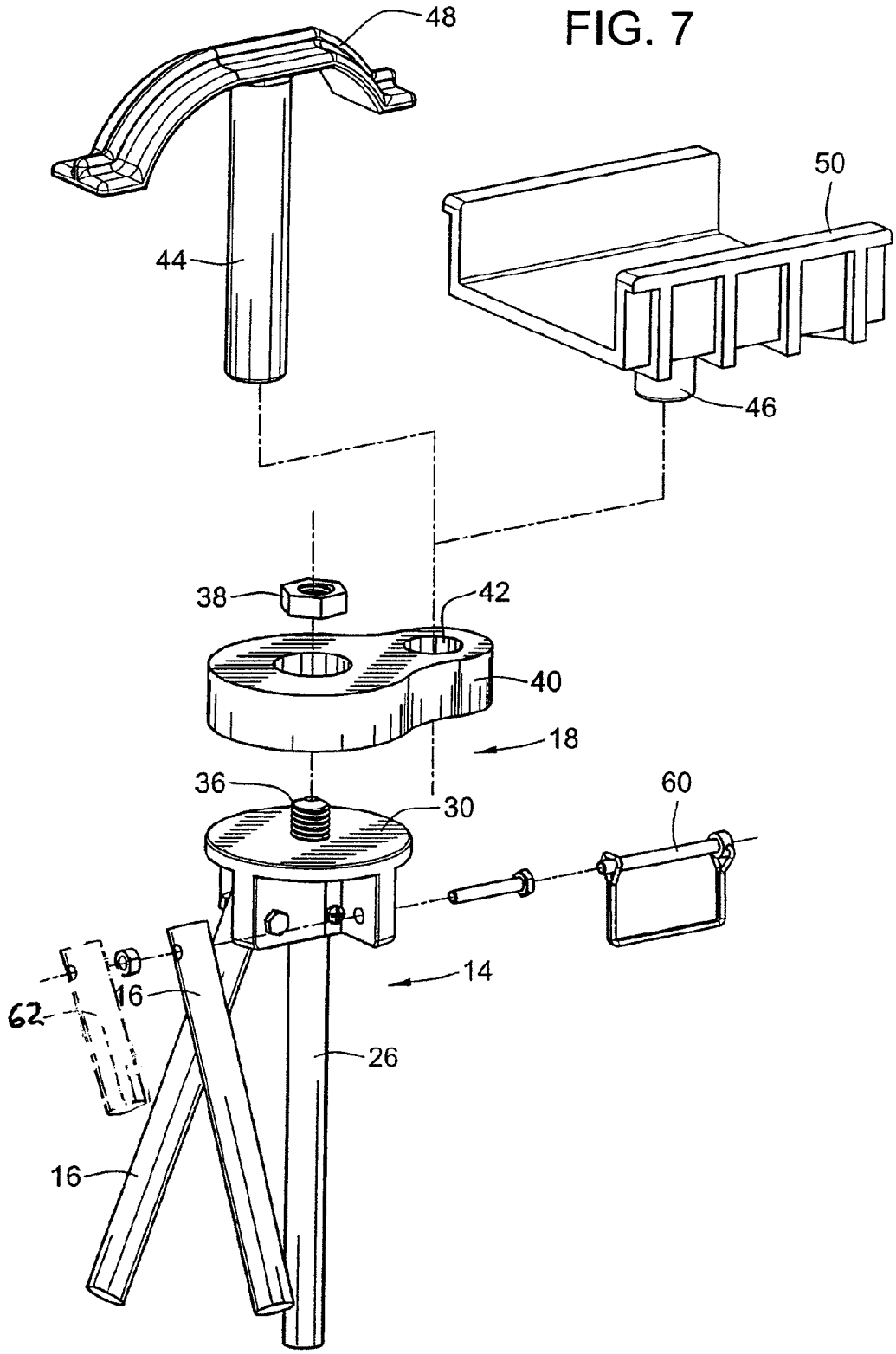

As shown in FIGS. 5-7, an upper pivot cap 30 is attached to the upper end of each of the inner vertical elements 26, in the exemplary embodiment. In similar fashion, a foot pivot cap 32 is attached to the bottom end of the outer tubular element 28 of each of the telescopic columns 14.

In the exemplary embodiment, the upper and foot pivot caps 30, 32 are each configured for pivotable attachments thereto of one end of two to four of the connecting rod 16, so that the plurality of telescopic columns 14 can be connected together in the manner illustrated in FIG. 1 for the exemplary embodiment of the expandable articulated support frame 12. By configuring the pivot caps 30, 32 in this manner, inventory requirements and cost are educed because only one configuration of upper pivot cap 30 and one configuration of foot pivot cap 32 are required to provide connections, regardless of the specific location of a given telescopic column 14 within the support frame 12.

Specifically, pivot caps 30, 32 attached to telescopic columns 14 located at the four outer corners of the support frame 12 have only two of the connecting rods pivotably attached thereto. Pivot caps 30, 32 attached to telescopic columns 14 located along the outer periphery of the support frame 12, between the four corners, have three connecting rods attached respectively thereto. Pivot caps 30, 32 attached to the three telescopic columns 14 in the interior of the support frame 12 provide for pivotable connection to the ends of four of the connecting rods 16.

It will be further noted that the connecting rods 16 form pairs thereof joined at a central pivot connection 34 between adjacent telescopic columns 14. The pivoting attachment configuration of the pivot caps 30, 32 are arranged in such a manner that the pairs of connection rods 16 are oriented, with respect to one another, so that they can pivot past one another when the support frame 12 is moved between the expanded and stowed positions thereof.

As shown in FIGS. 5-7, the upper pivot caps 30, at the upper ends 18 of the telescopic columns 14, in the exemplary embodiment, include a central threaded stud 36, for pivotable attachments thereto of a work piece support pad 40, by means of a nut 38. The support pad 40, of the exemplary embodiment, is formed from a material, such as particle board, plastic, or another suitable material, which, when struck by saws, routers, or other types of tools and bits utilized in the construction trades, will not tend to dull or cause damage to those tools and bits.

The upper pivot cap 30, including the central threaded stud 36, and the nut 38, are also preferably formed from a material, such as plastic, which will not tend to dull or damage any tools or bits during operations on work pieces supported by the support frame 12.

It will be further noted that the work piece support pads 40, of the exemplary embodiment, have a sufficient thickness such that the distal end of the central threaded stud 36 and nut 38 are recessed substantially below an upper surface of the support pad, to thereby provide protection for the threaded stud 36 and nut 38, should a saw blade, or other machining tool or bit, cut into the upper surface of the support pad 40. The support pads 40, of the exemplary embodiment, are also configured and attached to the upper ends 18 of the telescopic columns 14 in such a manner that the support pads 40 can be readily removed and replaced as they become worn by repeated contact with tools being utilized for cutting a work piece supported by the support pad 40.

The work piece support pads 40, of the exemplary embodiment, have a somewhat pear-shaped periphery and include a through hole 42 for receipt therein of the shank portion 44, 46 of various types of attachments, such as the hold-down clamp 48 and cradle 50 shown in FIG. 7. As shown in FIG. 2, the pear-shaped outer periphery of the work piece support pads 40 allow the support pads 40 to be tightly nested with one another, when the expandable articulated support frame 12 is in the stowed position, despite the presence of the protruding portion of the support pad 40 extending around the through hole 42.

As shown in FIG. 3, the configuration of the support pads 40, together with their pivotable attachment to the upper pivot caps 30, allow attachment devices, such as the hold-down clamp 48 to be positioned outside of the periphery of the sheet-type work piece 20. As shown in FIG. 4, the cradle attachments 50 may be utilized for supporting elongated work pieces 22, or for holding elongated materials, such as lengths of 2×4 lumber to form transversely extending support rails 52 for supporting an elongated work piece, such as the work piece 24 shown in FIG. 4. It will be noted that the exemplary embodiment of the invention allows the cradles 50 to be utilized for alternatively attaching a support rail 52 in a direction perpendicular to the long axis of the support frame 12, in a direction parallel to the long axis of the support frame 12, or at an angle to the long axis of the support frame 12.

As shown in FIG. 2, the exemplary embodiment of the work piece support apparatus 10 also includes a carrying and storage case 54, which is adapted to hold the expandable articulated support frame 12 in the stowed condition. The case 54 also includes provisions (not shown) for stowage of attachment devices such as the hold-down clamps 48 and cradles 50.

As stated above, the exemplary embodiment of the expandable articulated support frame 12 includes fifteen (15) telescopic columns 14 arranged on essentially two foot centers in a grid, such that when fully expanded, the center points of the telescopic columns 14 define a 4'×8' dimension. It is further contemplated, that the support frame 12 is constructed to hold the work piece at a convenient working height, such as 36 inches, for example.

Figure 8:
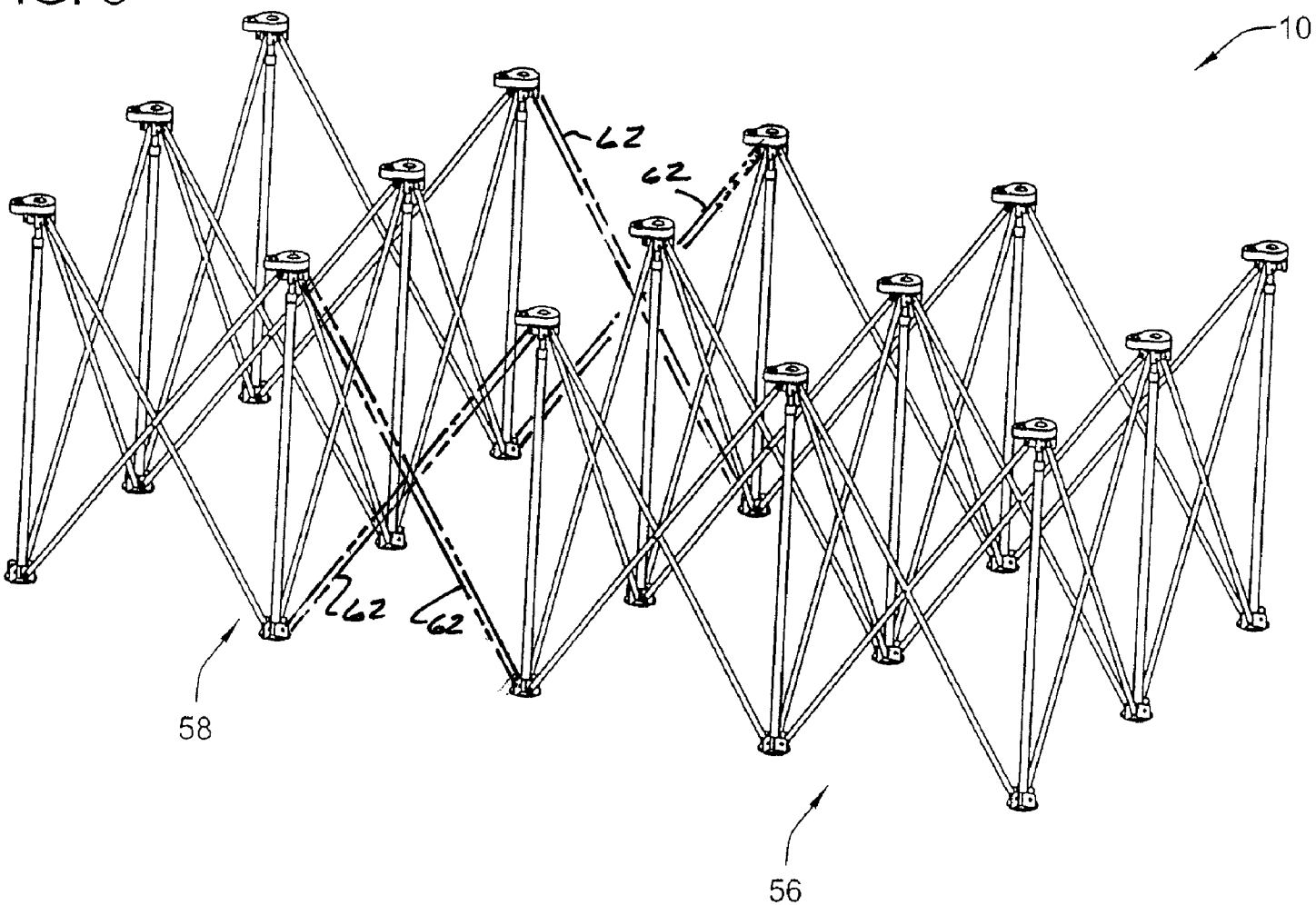
FIG. 8 shows a variation of the exemplary embodiment of the work piece support apparatus of FIG. 1

In other embodiments of the invention, however, it may be desirable to have an expandable articulated support frame having a different configuration than the exemplary embodiment disclosed above. For example, as shown in FIG. 8, it may be desirable to have a support frame formed from a lesser or greater number of telescopic columns 14. Furthermore, as indicated in FIGS. 7 and 8, some embodiments of the invention may include removable pivot pins 60 allowing multiple sections 56, 58 of expandable articulated support frames to be selectively joined together or uncoupled from one another, for a variety of purposes, such as meeting the needs of a particular construction job, fitting the support frame into an available work space, or otherwise configuring a work piece support apparatus, according to the invention, in an advantageous manner. As indicated by dashed lines in FIGS. 7 and 8, the multiple sections 56, 58 may be joined together, or separated as desired, by adding or removing removable connecting rods 62.

It may also be desired, in other embodiments of the invention, to reverse the relative locations of the inner and outer elements of the telescopic columns in other embodiments of the invention, although it is contemplated that it will generally be preferable to use the arrangement shown in the exemplary embodiment, so that the stop in the foot pivot is being compressed by the lower end of the inner vertical element against the floor or ground, to thereby utilize the ground to augment the structural strength of the foot pivot. It may further be desirable, in some embodiments of the invention, to use a different interconnection arrangement for the frame, or to have only a selected number of the telescopic members adapted at their upper ends for supporting a workpiece.

Those having skill in the art will recognize that the invention provides significant improvement over prior apparatuses and methods for supporting a work piece, and in particular for supporting sheet-type work pieces. In addition to the advantages pointed out above, it will be recognized that the relatively open structure provided by the expandable articulated support frame, according to the invention, allows substantial freedom for a construction worker or homeowner, to step into the frame in order to most effectively operate tools, or perform other operations on the work piece, while still having the work piece well supported by the support frame.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventor for carrying out the invention. Variations of those preferred embodiments may become apparent to those of ordinary skill in the art upon reading the foregoing description. The inventor expects skilled artisans to employ such variations as appropriate, and the inventors intend for the invention to be practiced otherwise than as specifically described herein.

Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. An apparatus, for supporting a work piece, comprising:

an expandable articulated support frame having two or more telescopic columns arranged in one or more rows and operatively interconnected by a connecting rods pivotably connected to the telescopic columns at intersections thereof, for alternatively positioning the frame in either a deployed position or a stowed position of the frame;

the telescopic columns each including an inner vertical element, an outer tubular element, an upper pivot cap, and a foot pivot cap, operatively connected to define a respective upper and lower end of each telescopic column;

the inner vertical element and the outer tubular element each defining upper and lower ends thereof, with the lower end of the inner vertical element being slidingly disposed within the outer tubular element and the inner vertical element having a length greater than the tubular element such that the upper end of the inner vertical element extends beyond the upper end of the outer tubular element in both the deployed and the stowed positions of the frame;

the upper pivot cap being attached to the upper end of the inner vertical element to at least partly define the upper end of the telescopic column, and the foot pivot cap being attached to and extending at least partly across the lower end of the outer tubular element in such a manner that a portion of the foot pivot cap extending at least partly across the lower end of the tubular element forms a stop for the lower end of the inner vertical element when the frame is in the deployed position thereof, with the foot pivot cap at least partly defining the lower end of the telescopic column;

the lower end of the inner vertical element resting upon the stop of the foot pivot cap when the frame is in the deployed position thereof in such a manner that a substantially vertically directed load applied to the upper pivot cap of the telescopic column and acting along the vertical element of the telescopic column is supported by the upper pivot cap, the inner vertical element and the foot pivot cap of the vertical element, and not by the outer tubular element, further comprising, a work piece support pad attached to the upper pivot cap of at least some of the upper pivot caps, for supporting the work piece; wherein, the upper pivot cap includes a threaded stud extending substantially upward from the upper end of the upper pivot cap and at least partially through the work piece support pad; the work piece support pad is pivotably secured to the upper pivot cap by a nut threadably engaging a distal end of the threaded stud, wherein the work piece support pad comprises a through hole therein, offset radially from the threaded stud, an attachment from the group consisting of: a hold-down clamp; and a cradle inserted into the through hole; wherein, the work piece support pad has a generally pear-shaped body being larger in periphery about the threaded stud than about the through hole, to facilitate nesting of the support pads with one another when the expandable articulated frame is positioned in a collapsed state thereof.

2. The apparatus of claim 1, wherein, the expandable articulated support frame comprises a plurality of telescopic columns arranged in rows and interconnected by a plurality of connecting rods pivotably connected to each other and the telescopic columns at intersections thereof, with upper ends of the telescopic columns being adapted for supporting the work piece thereupon in such a manner that the workpiece, while supported on the upper ends of the telescopic columns, may be cut with a cutting tool across the upper ends of the telescopic columns without operatively damaging the cutting tool or the upper ends of the telescopic columns of the support frame through contact of the cutting tool with one or more of the upper ends of the telescopic columns of the support frame.

3. The apparatus of claim 2, wherein, the expandable articulated support frame comprises first and second detachable sections thereof, selectively joinable to one another by a plurality of pairs of removable connecting rods.

4. The apparatus of claim 3, wherein, at least the first detachable section includes at least four telescopic columns operatively joined to form a free standing unit capable of supporting the workpiece on the upper ends of the telescopic columns of the first detachable section, when the first and second detachable sections are detached from one another.

5. The apparatus of claim 4, wherein, both the first and second detachable sections respectively each include at least four telescopic columns operatively joined to form first and second free standing units capable of separately supporting the workpiece on the upper ends of the telescopic columns of the first and second detachable sections, when the first and second detachable sections are detached from one another.

6. The apparatus of claim 5, wherein, the pairs of removable connecting rods are removable from both the first and second detachable sections, when the first and second detachable sections are detached from one another.

7. The apparatus of claim 5, wherein, the first and second detachable sections are adapted for supporting the workpiece when joined together and when detached from one another, with the workpiece simultaneously spanning at least a portion of both the first and second detachable sections and simultaneously supported by the upper ends of at least some of the telescopic columns of each of the first and second detachable sections.

8. The apparatus of claim 5, wherein, the removable pairs of connecting rods are operatively and selectively joinable to the detachable sections by removable pivot pins.

9. The apparatus of claim 2, wherein, the upper ends of the telescopic columns comprise a material that will not tend to damage the cutting tool.

10. The apparatus of claim 9, wherein, the upper ends of the telescopic columns comprise a material from the group consisting of: plastic; wood; particleboard; and composites.

11. The apparatus of claim 9, wherein, the upper ends of the telescopic columns comprise the upper pivot cap for pivoting attachment thereto of the connecting rods.

12. The apparatus of claim 11, wherein, the work piece support pad comprises a material that will not tend to damage the cutting tool.

13. The apparatus of claim 12, wherein, the work piece support pad is replaceable.

14. The apparatus of claim 12, wherein, the work piece support pad has a thickness thereof above the upper support cap for precluding contact of the cutting tool with the upper support cap in the event that the cutting tool penetrates the thickness of the work piece support pad.

15. The apparatus of claim 1, wherein, the upper ends of at least some of the telescopic columns are adapted for supporting the workpiece thereupon, and the apparatus further comprises:

one or more attachments mounted respectively on the upper end of one or more of the upper ends of the telescopic columns adapted for supporting the workpiece in such a manner that the workpiece, while positioned by the attachments and supported on the upper ends of the telescopic columns, may be cut with a cutting tool across the ends of the telescopic columns without operatively damaging the cutting tool or the upper ends of the telescopic columns of the support frame through contact of the cutting tool with one or more of the upper ends of the telescopic columns of the support frame.

16. The apparatus of claim 15, wherein:

the expandable articulated support frame comprises at least four telescopic columns arranged in rows and interconnected by the plurality of connecting rods pivotably connected to each other and the telescopic columns at intersections thereof to define a rectangular grid having a telescopic column at each corner of the rectangle and further defining an orthogonally oriented longitudinal and perpendicular row of the telescopic columns, with upper ends of the telescopic columns being adapted for supporting the work piece thereupon;

the apparatus includes at least two attachments in the form of cradles for receiving a board therein; and the attachments and upper ends of two or more of the telescopic columns are cooperatively configured such that the cradles may be alternatively selectively mounted to position the board in a direction extending parallel to the longitudinal row of telescopic columns, parallel to the perpendicular row of telescopic columns or at an angle to both the longitudinal and perpendicular rows of telescopic columns.

17. The apparatus of claim 1, wherein, the stop of the foot pivot cap has a thickness that is greater than a remainder of the foot pivot cap.

18. The apparatus of claim 1, wherein, the inner vertical element is tubular.

19. The apparatus of claim 1, wherein, the inner vertical member is at least partly solid, rather than tubular.

20. The apparatus of claim 19, wherein, the inner vertical element is solid at least at one end thereof at a point of juncture with the at least one of the upper pivot cap and the foot pivot cap.

21. The apparatus of claim 1, wherein:

the connecting rods each have respective upper and lower ends thereof, when the frame is in the deployed position, and being disposed in pairs of first and second connecting rods operatively connecting adjacent first and second telescopic columns;

the upper end of the first connecting rod of the pair being pivotably attached to the upper pivot cap of the first telescopic column, and the lower end of the first connecting rod being pivotably attached to the foot pivot cap of the second telescopic column; and the upper end of the second connecting rod of the pair being pivotably attached to the upper pivot cap of the second telescopic column, and the lower end of the second connecting rod being pivotably attached to the foot pivot cap of the first telescopic column.

22. The apparatus of claim 21, wherein, the first and second connecting rods are pivotably joined to one another by a central pivot connection where the first and second connecting rods cross one another.

* * * * *